US006932615B1

(12) United States Patent
Yeo

(10) Patent No.: US 6,932,615 B1
(45) Date of Patent: Aug. 23, 2005

(54) COAXIAL CONNECTOR WITH RF SWITCH

(75) Inventor: Woon Chul Yeo, Seongnam (KR)

(73) Assignee: HTEC Co., Ltd, Hwaseong-si ( * ) Notice: Subject to any disclaimer, the term of this patent is extended or adjusted under 35 U.S.C. 154(b) by 0 days.

(21) Appl. No.: 10/910,138

(22) Filed: Aug. 3, 2004

(30) Foreign Application Priority Data

Jul. 14, 2004 (KR) ..... 10-2004-0054867

(51) Int. Cl.[7] ..... H01R 12/00
(52) U.S. Cl. ..... 439/63
(58) Field of Search ..... 439/63, 188, 247, 439/607, 581, 578, 944; 200/51.1, 51.09

(56) References Cited

U.S. PATENT DOCUMENTS 6,280,214 B1 * 8/2001 Chang ..... 439/188
6,296,492 B1 * 10/2001 Fujimoto et al. ..... 439/63
6,520,785 B2 * 2/2003 Hida ..... 439/188
6,783,374 B2 * 8/2004 Uratani et al. ..... 439/83
6,808,405 B1 * 10/2004 Uratani et al. ..... 439/188
6,837,724 B2 * 1/2005 McDaid et al. ..... 439/188

* cited by examiner

*Primary Examiner*—J. F. Duverne
(74) *Attorney, Agent, or Firm*—Law Offices of Royal W. Craig

(57) ABSTRACT

The present invention relates to coaxial connector with an RF switch. In particular, a housing 10 covered with an external conductor 17 is composed of upper and lower housings 11 and 12. A fixed terminal 21 connected to an RF circuit is insert molded in the upper housing 11, and a movable terminal 25 that is selectively brought into contact with the fixed terminal 21 is insert molded in the lower housing 12. The movable terminal 25 comprises a fixed portion 26 fixed to the lower housing 12; a waist portion 27 extending upwardly from the fixed portion 26 at a first angle $\alpha 1$ and molded to the lower housing 12; and an elastic piece 28 bent from the tip end of the waist portion 27 at a second angle $\alpha 2$, extending into a space 15 of the housing, and being contact with the fixed terminal 21.

2 Claims, 4 Drawing Sheets

COAXIAL CONNECTOR WITH RF SWITCH

CROSS-REFERENCE TO RELATED APPLICATION(S)

This application claims the priority of Korean Patent Application No. 10-2004-54867, in the Korean Intellectual Property Office, the disclosure of which is incorporated herein in its entirety by reference.

BACKGROUND OF THE INVENTION

1. Field of Invention

The present invention relates to a coaxial connector, and more particularly, to a coaxial connector which is mounted on a circuit board of a mobile communication device such as a mobile phone and is provided with a switch for interrupting an RF circuit when a central conductor of a plug connector is assembled.

2. Description of the Prior Art

In general, a coaxial connector with an RF switch for checking high frequency circuits is employed in portable communication equipment such as mobile phones. An example of a coaxial connector with such an RF switch is disclosed in Japanese Laid-Open Publication No. 2003-123915.

As shown in FIG. 1, the conventional coaxial connector 100 comprises an insulated housing 102 with a hole 101 through which a central conductor 111 of a coaxial plug 110 is inserted, an external conductor 103 installed at the outer side of the insulated housing 102, and fixed and movable terminals 104 and 105 installed below the hole 101 of the insulated housing 102. The fixed terminal 104 includes a contact portion 106, and the movable terminal 105 includes a fixed portion 107 fixed to the insulated housing 102 and an elastic portion 108 brought into contact with the central conductor 111 of the coaxial plug 110. Therefore, when the central conductor 111 is inserted in the hole 101, the elastic portion 108 is separated from the contact portion 106 such that a signal circuit can be switched.

However, as mobile phones have become miniaturized, the conventional coaxial connectors have further microminiaturized. When a microminiaturized coaxial connector is assembled, a separately formed movable or fixed terminal is fitted into the groove or hole provided in the insulated housing. Accordingly, there is a problem in that when the assembled coaxial connector is mounted on the surface of a circuit board, flux flows into the terminal through the gap between the terminal and the groove of the insulated housing and thus poor contact is produced between the terminals. Further, there are other problems in that the failure rate is increased due to difficulty in assembling the microminiaturized parts with one another and the productivity of assembly is also reduced due to the increased number and complexity of the assembling processes.

Furthermore, as shown in FIG. 1, the conventional coaxial connector is configured in such a manner that the fixed portion 107 of the movable terminal 105 is bent at a large bending angle (i.e., "C" shaped) and fixed to the lower insulated housing 109 so as to support the elastic portion 108. Therefore, when the coaxial connector performs a switching operation by means of a force produced by the central conductor 111 of the coaxial plug 110, a great amount of stress is repeatedly exerted on the bent portion of the movable terminal and elastic characteristics are easily lost. Accordingly, there is another problem in that service life of the coaxial connector is short.

SUMMARY OF THE INVENTION

Accordingly, the present invention is conceived to solve the aforementioned problems of the conventional coaxial connector. It is an object of the present invention to provide a coaxial connector wherein the productivity of assembly is enhanced by allowing assembly work to be simplified and the durability of products is improved by reducing the stress exerted on terminals.

According to an aspect of the present invention for achieving the object, there is provided a coaxial connector with an RF switch, which comprises an insulated housing having a hole through which a central conductor of a coaxial plug is inserted, an external conductor installed around the outside of the insulated housing, and a switching mechanism including a fixed terminal fixed to the housing and a movable terminal elastically installed below the hole of the housing such that it is brought into contact with the fixed terminal when force from the central conductor of the coaxial plug is not exerted thereon and is separated from the fixed terminal to allow a signal circuit to be switched when it is pressed by the central conductor of the coaxial plug. Further, the insulated housing is composed of upper and lower housings which are assembled with each other. The upper housing comprises an upper insulated body with a hole formed along a central axis of the housing and a skirt portion extending downward along a longitudinal direction from a lower end of the upper insulated body to define a space therein, and the fixed terminal is insert molded and installed in the skirt portion such that the upper tip end thereof is exposed to the space when the upper housing is injection molded in a mold. Furthermore, the lower housing comprises a base and a sidewall extending upwardly from the base to define an annular wall surrounding the space together with the skirt portion of the upper housing, and the movable terminal comprises a fixed portion which is insert molded to the lower end of the lower housing when the lower housing is injection molded in a mold, and a waist portion which extends into the space from the fixed portion and includes an elastic portion elastically brought into contact with a lower surface of the fixed terminal at an upper portion of the movable terminal.

According to the coaxial connector of the present invention configured as above, since the movable and fixed terminals are insert molded in the insulated housing when the insulated housing is injection molded, additional assembly processes are not required. Therefore, the productivity of assembly can be enhanced, the occurrence of failure due to assembly work made by unskilled workers can be prevented, and the quality of products can also be uniformly maintained.

Further, the coaxial connector of the present invention is configured in such a manner that the movable terminal of the switching mechanism for switching an RF switching circuit comprises a waist portion which extends upwardly from the fixed portion fixed to the lower housing at a first angle $\alpha 1$ smaller than 90° with respect to a horizontal direction and is molded to the lower housing, and an elastic piece which is again bent from a tip end of the waist portion at a second angle smaller than the first angle with respect to the horizontal direction, extends into the space of the insulated housing to be exposed thereto, and elastically comes into contact with the fixed terminal.

Since the movable terminal is bent at an acute angle, stress that is exerted on the movable terminal when it is pressed by the central conductor of the coaxial plug is relatively small. Accordingly, no plastic deformation is produced in the movable terminal, and thus, poor contact with the fixed terminal prevented even though it is used for a long time.

BRIEF DESCRIPTION OF THE DRAWINGS

The above and other objects and features of the present invention will become apparent from the following description of preferred embodiments given in conjunction with the accompanying drawings, in which.

DETAILED DESCRIPTION OF THE INVENTION

Hereinafter, a preferred embodiment of a coaxial connector according to the present invention will be described in detail with reference to the accompanying drawings.

Figure 1:
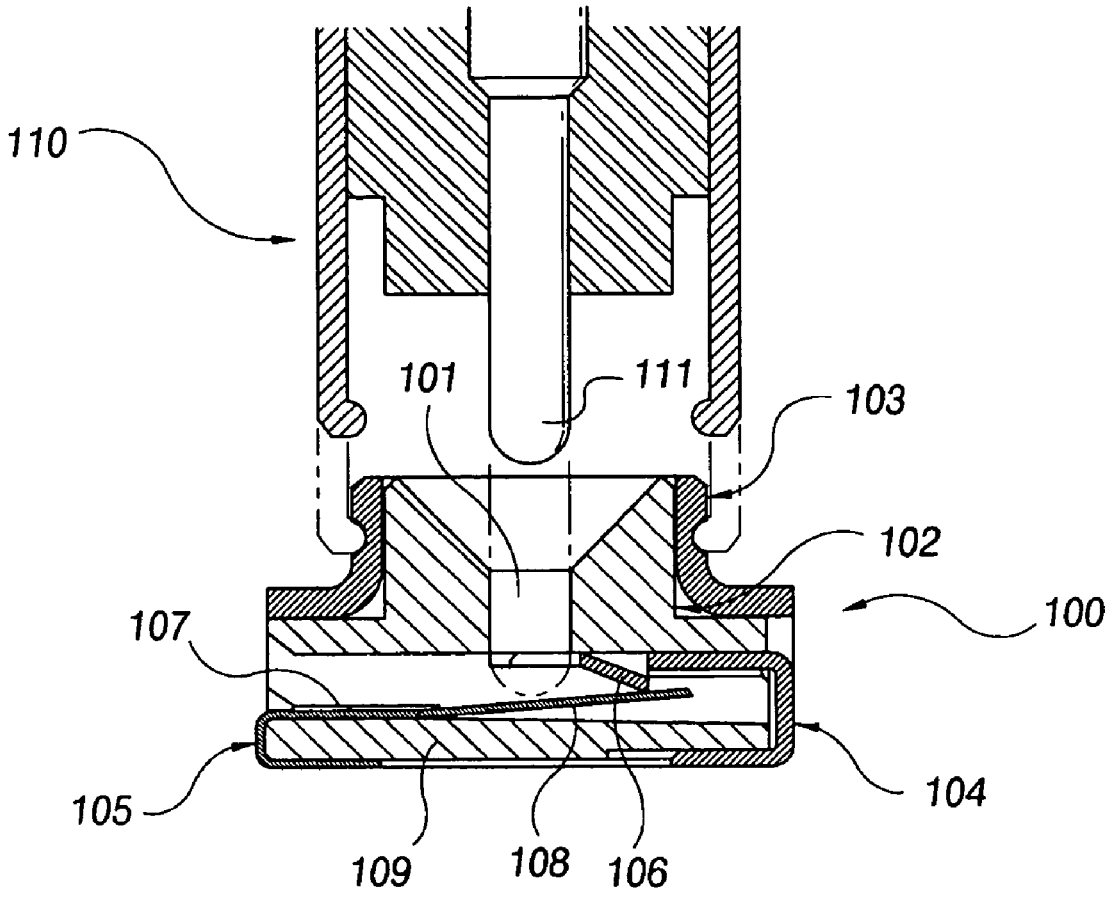
FIG. 1 ( PRIOR ART )
FIG. 1 is a sectional view showing an engagement state of a conventional coaxial connector.
Figure 2:
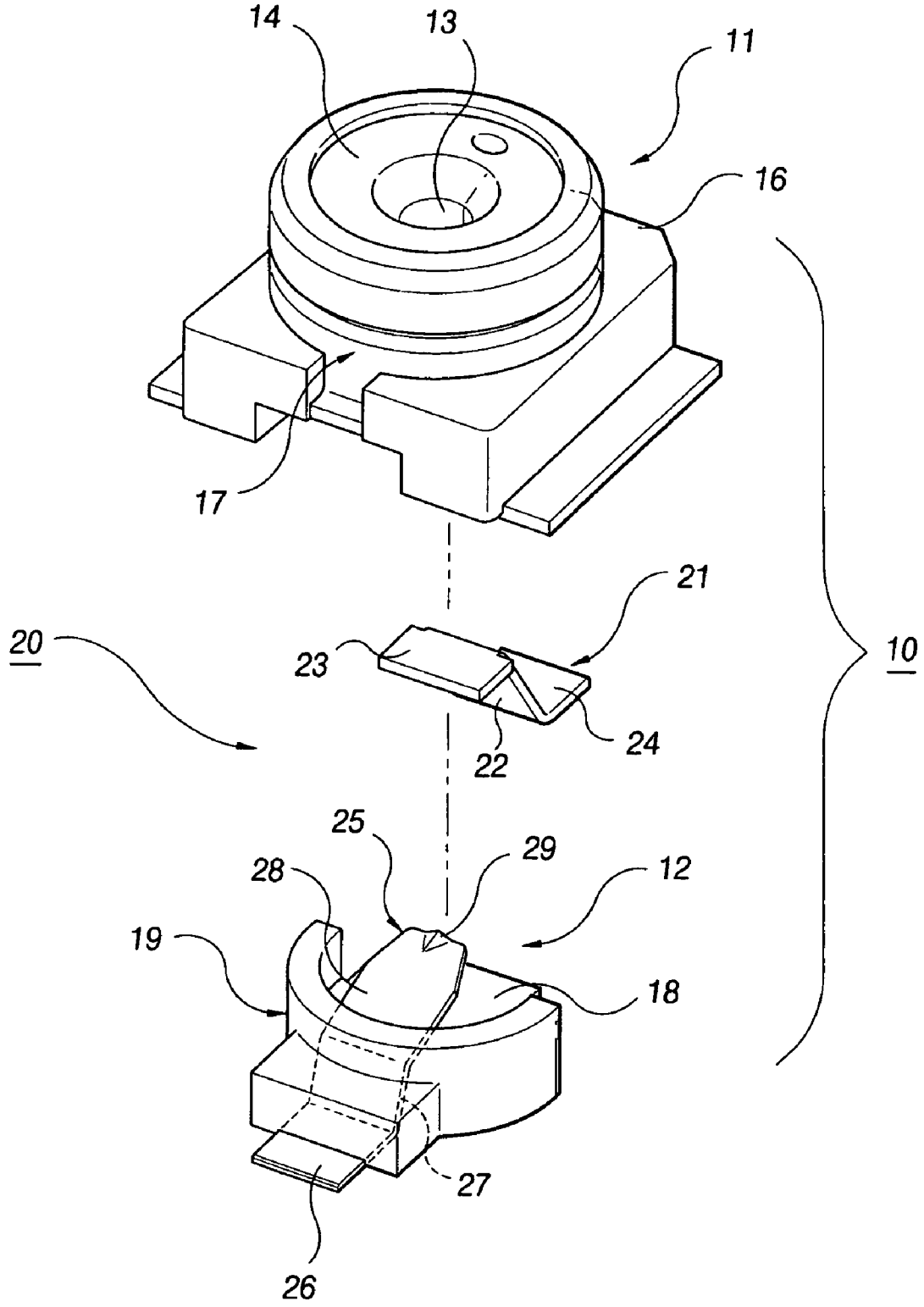
FIG. 2 is an exploded perspective view of a coaxial connector according to the present invention.
Figure 3:
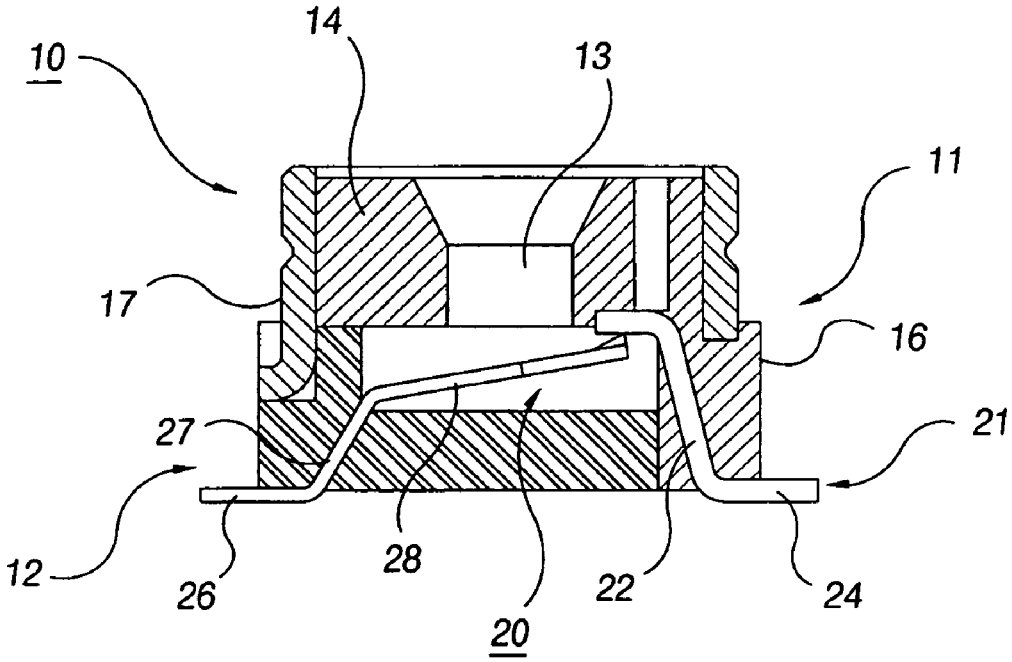
FIG. 3 is a sectional view showing the assembled coaxial connector according to the present invention.

FIG. 2 is an exploded perspective view of a coaxial connector according to the present invention, and FIG. 3 is a sectional view showing an engagement state of the coaxial connector according to the present invention. As shown in these figure, the coaxial connector of the present invention comprises a housing 10, an external conductor 17 covered around the outside of the housing 10, and a switching mechanism 20 for switching an RF signal circuit installed on a circuit board of a communication device such as a mobile phone.

Figure 4:
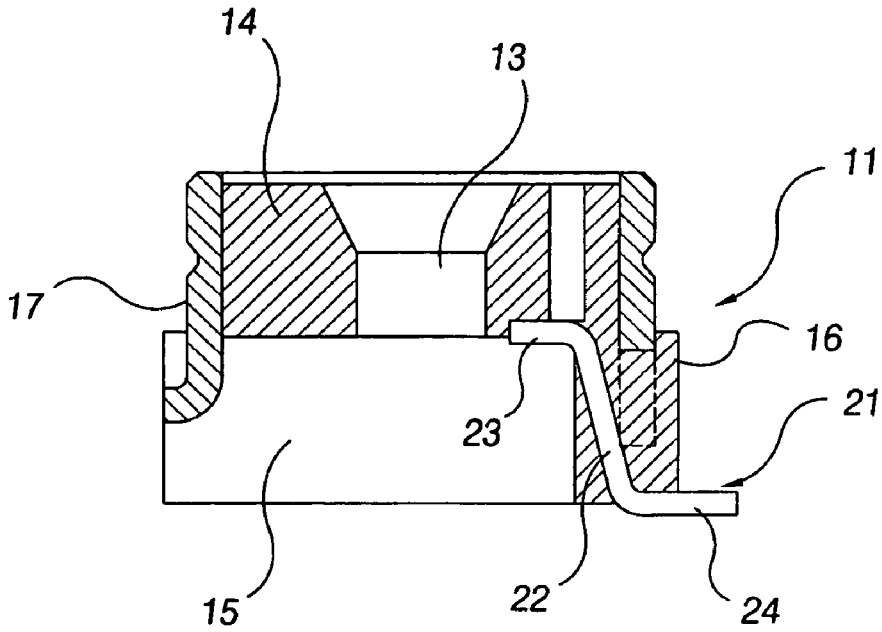
FIG. 4 is a sectional view of an upper housing of the coaxial connector according to the present invention.

The housing 10 is composed of upper and lower housings 11 and 12 which are assembled with each other and generally shaped as a cylinder. As shown in FIGS. 2 to 4, the upper housing 11 comprises an upper insulating body 14 and a skirt portion 16. Here, a hole 13 into which a central conductor of a coaxial plug is inserted is perforated through the upper housing 14 in along a central axis of the housing, and the skirt portion 16 extends downward along a longitudinal direction from a lower end of the upper insulating body 14 to define a space 15 within the center thereof. Further, the external conductor 17 is covered around the outer circumferential surface of the upper insulating body 14 to be connected with an external conductor of the coaxial plug.

Figure 5:
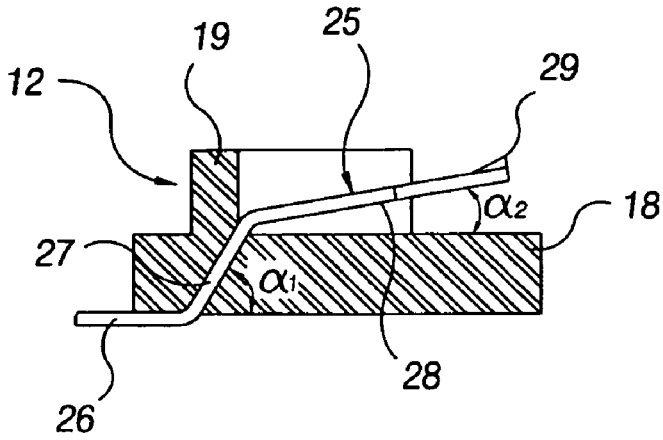
FIG. 5 is a sectional view of a lower housing of the coaxial connector according to the present invention.

As shown in FIGS. 2 and 5, the lower housing 12, which is engaged with the upper housing 11 in a coaxial mode upwardly from the upper housing 11, comprises a base 18 which is brought into close contact with the circuit board, and a sidewall 19 which extends upwardly from the base 18 to define an annular wall surrounding the space 15 together with the skirt portion 16 of the upper housing 11.

Figure 6:
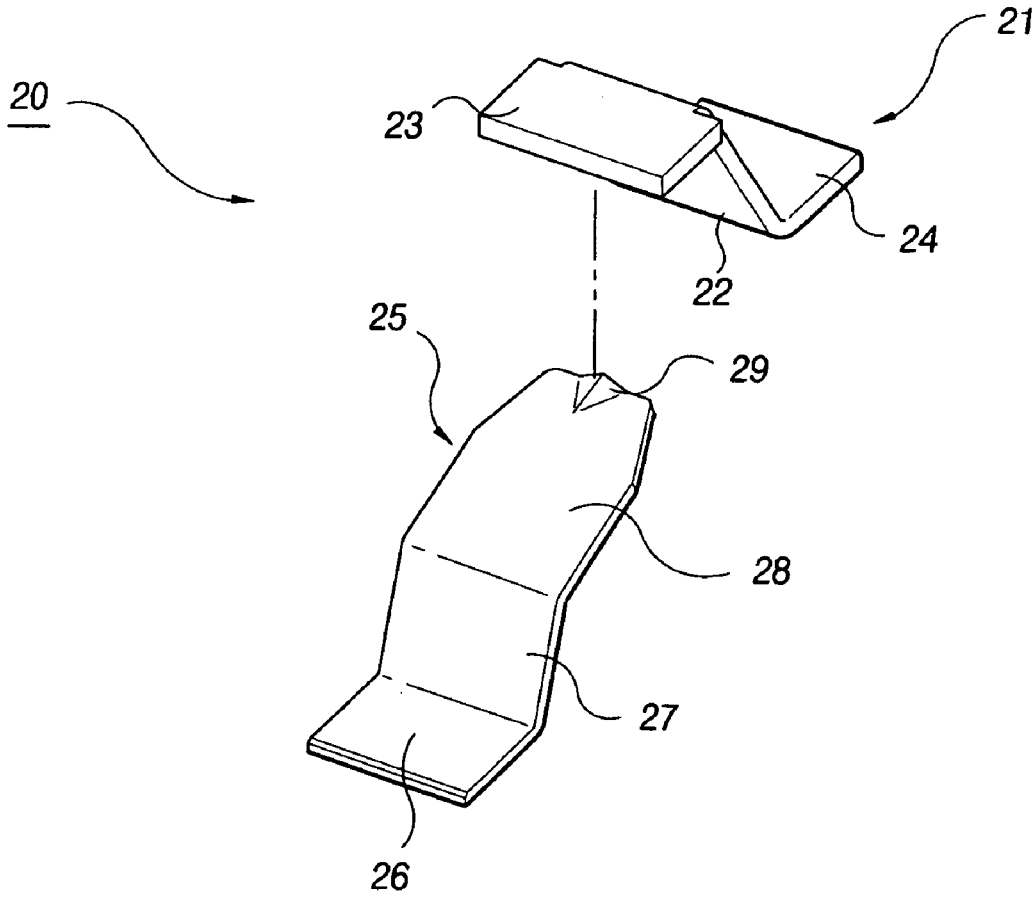
FIG. 6 is an exploded perspective view of a switching mechanism separated from the coaxial connector according to the present invention.

A fixed terminal 21 of the switching mechanism is installed into the upper housing 11. The fixed terminal 21 is assembled in the upper housing 11 by bending a thin metal plate as shown in FIG. 6 and then causing the bent metal plate to be insert molded upon injection molding of the upper housing 11. The fixed terminal 21 comprises a body 22 which is embedded in the skirt portion 16 of the upper housing 11, a contact end 23 which is bent generally toward a horizontal direction and extends to an upper portion of the space 15 of the upper housing 11 from the upper end of the body 22, and a foot 24 which extends from the lower end of the body 22 in a horizontal direction to be exposed outwardly from the bottom of the body 22 and is soldered onto the circuit board.

A movable terminal 25 of the switching mechanism 20 is installed into the lower housing 12 by causing the movable terminal 25 to be insert molded upon injection molding of the lower housing 12. As shown in FIG. 6, the movable terminal 25 comprises a fixed portion 26 which is inserted molded in and fixed to the base 18 generally in a horizontal direction, exposed outwardly along the bottom surface of the base 18 and bonded to a circuit on the circuit board; a waist portion 27 which extends upwardly from the fixed portion 26 at a first angle $\alpha 1$ smaller than 90° with respect to the horizontal direction and is molded to the sidewall 19 of the lower housing 12; and an elastic piece 28 which is bent from the tip end of the waist portion 27 at a second angle $\alpha 2$ smaller than the first angle $\alpha 1$ with respect to the horizontal direction, extends into the space 15 of the housing to be exposed thereto, and elastically comes into contact with the fixed terminal 21 of the upper housing 11.

The upper housing 11 is coaxially engaged with the lower housing 12 from above such that they generally define a cylindrical housing as shown in FIGS. 2 and 3. In such a state, when the central conductor of the coaxial plug is inserted into the hole 13 of the housing and urges the elastic piece 28 of the movable terminal 25 to move downwardly, the elastic piece 28 is separated from the contact end 23 of the fixed terminal 21. Thus, the circuit is interrupted or opened. Further, when the coaxial plug is separated from the coaxial connector of the present invention in such a state, the elastic piece 28 of the movable terminal 25 that is being pressed by the central conductor is restored into an original position by means of its own elastic force and again brought into contact with the contact end 23 of the fixed terminal 21. Accordingly, the circuit is closed.

As shown in FIGS. 2 and 6, the elastic piece 28 of the movable terminal 25 is formed with a contact protrusion 29 which is sharply formed such that the elastic piece 28 can be brought into point contact with the contact end 23 of the fixed terminal 21.

According to the coaxial connector of the present invention, since the movable and fixed terminals are installed into the housing by causing the terminals to be insert molded upon the injection molding of the housing, no gap is produced between the housing and the terminals. Therefore, when the coaxial connector is mounted onto the circuit board, no flux can flow into the gap defined between the housing and the terminals. Accordingly, any faults or failure due to flux inflow can be avoided.

Further, since an additional assembly process is not required in installing the terminals to the housing, the productivity of assembly can be enhanced. Moreover, the occurrence of failure due to assembly work made by unskilled workers can be prevented and the quality of products can also be uniformly maintained. Furthermore, since the movable terminal is bent at an acute bending angle, stress that is exerted on the terminal when it is pressed by the central conductor of the coaxial plug is relatively small. Accordingly, no plastic deformation is produced in the movable terminal, and thus, poor contact with the fixed terminal is avoided even though it is used for a long time.

The coaxial connector of the present invention is a coaxial connector which is mounted on a surface of a circuit board of a small-sized communication terminal such as a mobile phone and provided with an RF switch for interrupting an RF circuit when a coaxial plug is inserted therein upon inspection of the RF circuit.

What is claimed is:

1. A coaxial connector with an RF switch, including a housing (10) having a hole (13) through which a central conductor (P) of a coaxial plug is inserted, an external conductor (17) installed around the outside of the housing (10), and a switching mechanism (20) having a fixed terminal (21) fixed to the housing (10) and a movable terminal (25) elastically installed below the hole (13) of the housing (10), the movable terminal (25) being configured such that it is brought into contact with the fixed terminal (21) when a force from the central conductor (P) of the coaxial plug is not exerted thereon and it is separated from the fixed terminal (21) to allow a signal circuit to be switched when it is pressed by the central conductor (P) of the coaxial plug, wherein:

the housing (10) is composed of upper and lower housings (11, 12) which are assembled with each other, the upper housing (11) comprises an upper insulating body (14) with the hole (13) formed in along a central axis of the housing and a skirt portion (16) extending downward along a longitudinal direction from a lower end of the upper insulating body (14) to define a space (15) therein, and the lower housing (12) comprises a base (18) and a sidewall (19) which extends upwardly from the base (18) to define an annular sidewall surrounding the space (15) together with the skirt portion (16) of the upper housing (11); and the fixed terminal (21) is insert molded and installed in the skirt portion (16) such that an upper tip end thereof is exposed to the space (15) when the upper housing (11) is injection molded in a mold, and the movable terminal (25) is insert molded and installed in the sidewall (19) when the lower housing (12) is injection molded in a mold.

2. The coaxial connector as claimed in claim 1, wherein the movable terminal (25) comprises a fixed portion (26) which is supported on and fixed to the lower housing (12); a waist portion (27) which extends upwardly from the fixed portion (26) at a first angle ($\alpha 1$) smaller than 90° with respect to a horizontal direction and is molded to the lower housing (12); and an elastic piece (28) which is again bent from the tip end of the waist portion (27) at a second angle ($\alpha 2$) smaller than the first angle ($\alpha 1$) with respect to the horizontal direction, extends into the space (15) of the housing (10) to be exposed thereto, and elastically comes into contact with the fixed terminal (21).

* * * * *